United States Patent [19]

Morelock

[11] 4,082,129

[45] Apr. 4, 1978

[54] METHOD AND APPARATUS FOR SHAPING AND PLANING BOARDS

[76] Inventor: Donald L. Morelock, Rte. 1, Box 468, West Linn, Oreg. 97068

[21] Appl. No.: 734,000

[22] Filed: Oct. 20, 1976

[51] Int. Cl.[2] ..... B27C 9/04; B27C 5/06

[52] U.S. Cl. ..... 144/326 R; 144/3 R; 144/134 A; 144/242 R; 144/242 E; 144/245 R; 144/246 R; 144/309 L

[58] Field of Search ..... 144/1 R, 2 R, 3 R, 3 E, 144/36, 114 R, 117 R, 120, 134 R, 134 A, 242 R, 242 L, 243, 245 R, 245 C, 246 R, 246 B, 323, 326 R, 309 R, 309 L, 242 E

[56] References Cited

U.S. PATENT DOCUMENTS

| | | | |
|---|---|---|---|
| 2,300,728 | 11/1942 | Goss | 144/309 L |
| 2,571,861 | 10/1951 | Gegumis | 144/36 |
| 3,927,705 | 12/1975 | Cromeens et al. | 144/246 B |

*Primary Examiner*—Donald R. Schran
*Assistant Examiner*—W. D. Bray
*Attorney, Agent, or Firm*—Chernoff & Vilhauer

[57] ABSTRACT

A method and apparatus for shaping the edges and planing a surface of elongate boards in a single integrated operation so that the sides and ends thereof are interlockingly matched with complementary shapes. A leading end of each board is moved laterally past a first edge cutting head which cuts a first shape therein. Then the board is moved longitudinally past the same cutting head such that the same shape is cut in a first side thereof. After a portion of the first side is cut, one of the faces of the board is planed by a cutting head and, subsequently, the board is moved longitudinally past a second edge cutting head which cuts a shape in the second side of the board complementary to the shape previously cut in the first side. After cutting of the second side of the board is completed, the trailing edge of the board is moved laterally past the second cutting head which shapes the trailing edge similar to the second side so as to be complementary to the shape previously cut in the board's leading edge. This method is carried out by an apparatus which utilizes only one cutting head to shape two adjacent edges while minimizing the necessary manipulation of the board. The operations are executed by two movable carriages for moving and positioning the boards and a central table housing the cutting heads. The operations of the carriages, cutting heads and various guide mechanisms are governed by a hybrid control system utilizing pneumatic, hydraulic and electric power transfer and control means. The apparatus also accepts random length boards, is adjustable to a variety of graded width boards, and automatically loads raw boards and stacks finished boards.

21 Claims, 12 Drawing Figures

FIG. 2

METHOD AND APPARATUS FOR SHAPING AND PLANING BOARDS

BACKGROUND OF THE INVENTION

This invention relates to methods and apparatus for shaping and planing wood products, particularly elongate wood paneling boards.

In the wood products industry there is a demand for elongate boards whose side edges are cut to interlocking shapes so that adjacent sides of adjacent boards will matingly fit together, thereby providing additional strength to a surface constructed from a plurality of such boards for resistance against bending and independent movement of the individual boards. Typically, one side edge of such a board is provided with a protrusion running throughout the length of the board in the center of the edge and the other side edge of the board is provided with a groove likewise running throughout the length of the board in the center of the edge for receiving the protrusion of an adjacent board, which is commonly referred to as "tongue-and-groove" matching. The need for side edge matching is particularly great in the use of interior wall paneling in order to keep the visible surfaces of adjacent board even with one another to achieve an orderly appearance, though the need for such matching also arises in the construction of wood flooring, exterior paneling and the like.

It has long been known how to shape the side edges of boards with matching, interlocking cuts. For example, the apparatus disclosed in Knight U.S. Pat. No. 16,777 cuts interlocking shapes on the two side edges of an elongate board, and planes and sands a face of the board as well. Such a machine may be adjusted to accept a variety of different width boards. Woods U.S. Pat. No. 364,743 likewise discloses a machine for planing a face of a board and cutting matching side edges therein, including powered rollers which move the board entirely through the machine.

Ordinarily during construction of a panelled wall such side-matched boards are cut to a length such that their ends come together at a stud or other supporting structure in order to provide support for those ends. Without such support of the ends, lateral bending of the boards may occur, resulting in an uneven surface and reduced strength thereof. However, the need to bring ends of side-matched boards together at a stud results in wastage of material, since pieces which must be cut off the ends of such boards either in the manufacturing process or in the actual construction of a wall are often too short to be utilized between studs and therefore are discarded. Also, the need to bring board ends together at studs limits the variation in appearance of such walls due to the regularity of joint positions which is caused by bringing ends together at studs, which are typically uniformly spaced.

The aforementioned wastage of wood paneling and uniformity of appearance can be avoided by cutting interlockingly matching shapes in the opposite end edges of such boards as well as in the side edges. That is, one end and an adjacent side may be cut with a tongue shape and the other end and side with a groove shape so that the ends of such board need not necessarily be joined at studs to provide the needed support to avoid lateral bending. By utilizing end matching, boards which are too short to be used between studs may be incorporated in a wall, and boards which are not equal in length to the distance between an integral number of studs may be used without cutting down to the distance between an integral number of studs, thereby avoiding the cutting of more than a very short portion off the end of any board in the construction of a paneling surface such as a wall.

End matching of boards has heretofore been achieved primarily by the use of an apparatus known as a "double-end tenoner" which has two opposing rails for supporting cutting implements to shape edges of a board and a means for feeding boards through the machine between the two rails. In the use of this apparatus to match the ends of paneling boards, the raw boards are first graded according to length and width. Thereafter the double-end tenoner must be adjusted so that the distance between the two cutting rails is equal to the length of the boards to be end-matched, and the cutting apparatus on the rails must be arranged to cut interlockingly matching shapes on opposite ends of the boards. The boards are then fed through the machine laterally one by one to be cut. After the boards are cut on their ends by the double-end tenoner they must then be run longitudinally through a molding machine such as the aforedescribed apparatus to match their side edges and plane their faces. The same process can be achieved in an even less efficient manner by running each edge of the board through a single side shaper and thereafter running the boards through a planer. In either case these procedures are time consuming, complicated and require more than one machine.

Accordingly, there is a need for an apparatus which, in a single operation, cuts interlockingly matching shapes in opposite end and side edges of a board and planes a face thereof. Moreover, such a machine should ideally accept random lengths of board and be adjustable to varying widths.

SUMMARY OF THE INVENTION

The present invention overcomes the drawbacks and inefficiencies of prior art methods and apparatus for shaping the edges and planing a face of paneling board by providing a novel method and apparatus which enables paneling boards to be shaped on all edges and planed in a single operation whereby random length boards of a given width are removed from a stack of such boards, shaped on all edges, planed, and unloaded automatically. Also, the invention minimizes the number of cutting tools necessary to shape the edges and plane a face of such boards and reduces the time and effort heretofore required to accomplish the same result.

A novel approach to both end and side matching of paneling boards is provided by the method of the present invention due to the utilization of a single stationary rotating shaping head to cut two distinct edges of a board, that is, an end and an adjacent side, while minimizing the required manipulation of the board. Also, the invention utilizes a unique sequence of end cutting, side cutting and surface planing to produce the finished product. Accordingly, in the method of the present invention a first end edge of a board is cut to a first shape, for example a groove, by a first cutting head. Then the same cutting head cuts the same shape in an adjacent first side edge of the board. After the first side edge of the board is shaped, a face of the board is planed, and subsequently the second side edge of the board is cut by a second cutting tool giving it a second shape, for example a tongue. After cutting of the second side edge is complete the remaining end edge of the board is cut by the second cutting head giving it the same shape as the second side edge, that is, a shape which interlockingly matches with the opposite end. Depending upon the length of board being operated upon, several of the aforementioned steps may be taken simultaneously, thereby reducing the time of operation on a single board.

A unique apparatus for performing the aforementioned method utilizes a movable input carriage which supports a raw board to be cut and positions it for cutting. The carriage moves laterally with respect to the dimensions of the board, drawing the first end of the board across the first cutting head in contact therewith and then feeds the board longitudinally past the same cutting head so that the first side contacts the same head which cuts the first side with the same shape as the first end. All the cutting heads are located on a central table adjacent the input carriage so that the input carriage feeds the board onto the central table, and as the board passes over the table it is grasped by feed rollers mounted thereon which continue to feed it through the machine. After a portion of the first side has been cut the leading edge of the board passes beneath a face cutting head which planes the board. After a portion of the board passes beneath the face cutting head, its second side comes in contact with a second edge cutting head which cuts a second shape in that edge. Thus, if a board is long enough both sides and a face of the board may simultaneously be shaped.

As the board continues past the second edge cutting head it is fed onto a movable output carriage. After the entire board has passed over the central table onto the output carriage, a backstop drops behind the trailing edge of the board and the output carriage feeds the board backward into abutment with the backstop. Thereafter the output carriage moves the remaining uncut end of the board across the second cutting head which shapes that end the same as the second side then ejects the board from the apparatus, thereby finishing the operation.

Proper positioning of a board as it moves through the apparatus is ensured by the use of several rigid side fences mounted respectively on the input carriage, central table and output carriage, a front fence mounted on the central table in association with the input carriage, the backstop, side rollers for holding the boards against the side fences, and clamps mounted on each carriage which secure boards in position as their ends are being cut. The side fences maintain the proper cutting depth of the side edges and, in combination with the end fence and backstop, the cutting depth of the two end edges. A unique combination of edge shaping heads, idler rollers and feed rollers mounted on the carriages and central table, and a face cutting head enable boards automatically to be fed through the machine individually in random lengths and minimizes the time for performing the shaping and planing operations.

A novel apparatus control system utilizes a pneumatic pressure supply, a plurality of pneumatic control valves, a plurality of pneumatic cylinders which both actuate positioning mechanisms and act as air springs, a hydraulic pressure supply, and a plurality of hydraulic cylinders and motors which move the carriages and feed boards through the machine. The pneumatic system provides fast and clean control logic while the hydraulic system provides adequate positive power to move the carriages and boards. Also, the cutting heads are operated by individual electric motors to produce a combination of high rpm and positive power. Such a hybrid control system provides great flexibility in modifying the sequence and timing of operational events as well as the functional features of the invention. For example, by the actuation of manual pneumatic valves the carriages may be locked in place to run boards straight through the machine shaping only the two sides and the exposed surface without shaping the ends.

The apparatus will accept boards in random lengths and provides a means for adjusting the width of the boards which it will accept. Also, it may be provided with an automatic board loading feature and means for unloading the finished boards automatically upon completion of the cutting.

Therefore, it is a principal objective of the present invention to provide a new and improved, more efficient method and apparatus for shaping the edges and planing the faces of boards.

It is another objective of the present invention to provide such a method and apparatus which utilizes only one cutting head to cut two distinct edges of a board while minimizing the required manipulation of the board.

It is a further objective to provide a method and apparatus which, in one integrated operation, cuts the sides and ends of a paneling board to interlockingly matching shapes and planes a face of the board.

It is yet another objective of the present invention to provide such a method and apparatus for removing boards from a stack of width graded boards, shaping all of their edges, planing their faces, and unloading the finished boards.

It is a principal feature of the present invention that it utilizes a pair of movable carriages which precisely move a board to be cut past a cutting head in two different directions.

It is another feature of the present invention that it utilizes a unique combination of only two edge cutting heads, several feed rollers and guide mechanisms, and an exposed surface cutting head for completely edge matching and planing a raw board.

It is a further feature of the present invention that it utilizes a means for adjusting the width of boards which it will accept and provides a mechanism for loading width graded boards into the machine and unloading finished boards when they are done.

The foregoing objectives, features and advantages of the present invention will be more readily understood upon consideration of the following detailed description of the invention taken in conjunction with the accompanying drawings.

DETAILED DESCRIPTION OF THE INVENTION

Figure 3:
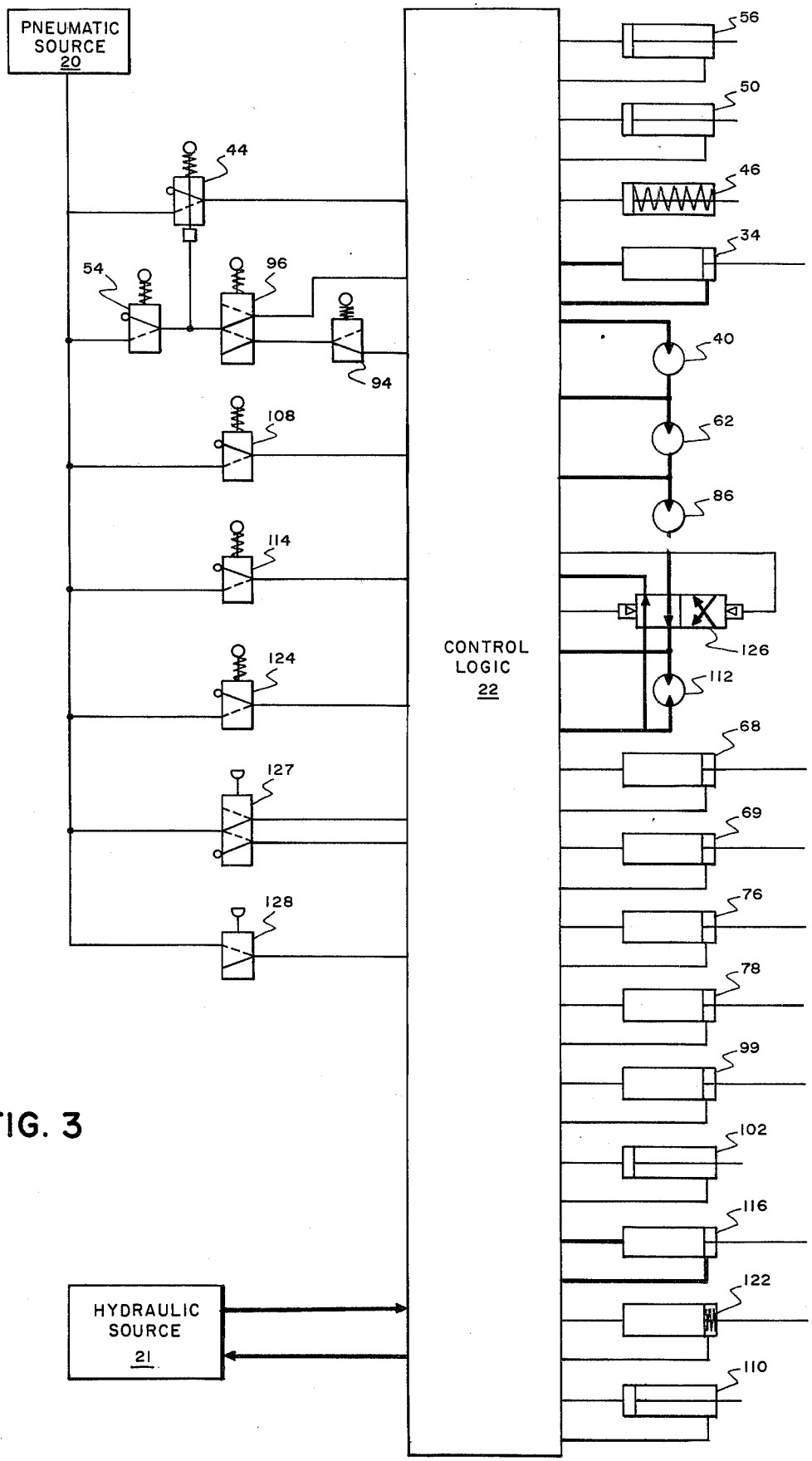
FIG. 3 is a schematic diagram of an exemplary control system for use in the aforementioned apparatus.

Referring first to FIGS. 1A-1D the exemplary shaping and planing apparatus of the present invention utilizes a central table 10, having a first rotating edge cutting head 12, a face cutting head 14 and a second rotating edge cutting head 16. The input side of the apparatus is provided with a movable input carriage 18, and the output side is provided with a movable output carriage 19. The operation of the apparatus is governed by a control system having a pneumatic pressure source 20, a hydraulic pressure source 21, numerous control valves, pistons and motors, and control logic 22, as shown in FIG. 3.

Figure 1A:
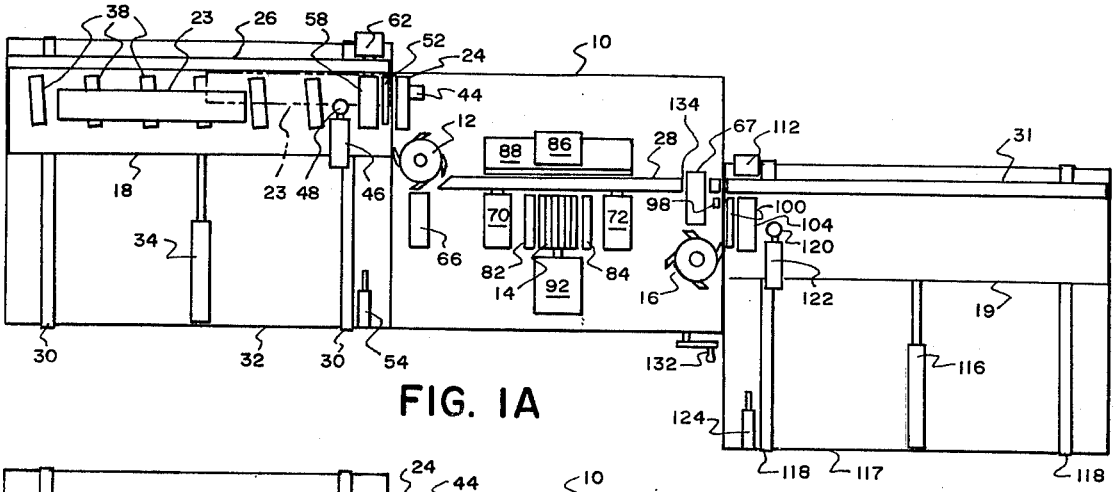
FIG. 1A is a top schematic view of an exemplary apparatus according to the principles of this invention, showing the apparatus in its starting configuration with a raw wood paneling board placed thereon.

Initially, in the performance of the subject method, a wood paneling board 23, ordinarily elongate in shape, is placed upon the input carriage 18 where it is moved into position against an end fence 24 and an input side fence 26, as shown in FIG. 1A, in preparation for the cutting of the leading end edge of the board by the first edge cutting head 12. Thereafter, the input carriage 18 is moved to a translated position shown in FIG. 1B, thereby moving the leading end of the board 23 laterally past the cutting head 12 which shapes the end of the board appropriately, typically giving it either a tongue or a groove shape for tongue-and-groove matching.

Figure 1B:
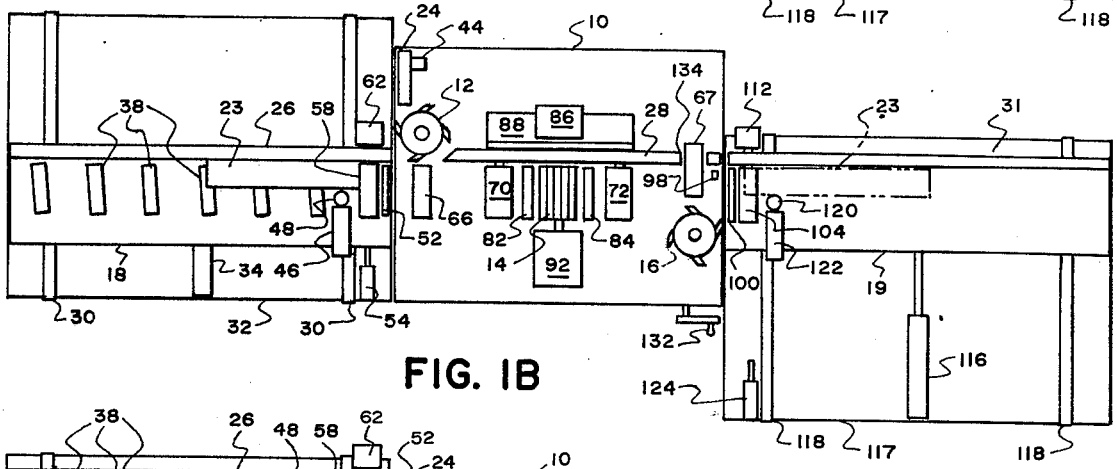
FIG. 1B is a top schematic view of the aforementioned exemplary apparatus in a first intermediate configuration showing the board after it has been shaped along one end edge thereof.

With the input carriage in its translated position the input side fence 26 is aligned with a central side fence 28 on the central table. The board 23 is then fed longitudinally onto the central table such that one side of the board contacts the first cutting head 12 and is cut to the same shape as the leading end of the board, the top face of the board is planed as it passes beneath the face cutting head 14, and the remaining side of the board moves past the second cutting head 16 which cuts a shape in the remaining side, typically complementary to the shape cut by the first cutting head 12. That is, if the cutting head 12 cuts a tongue, the cutting head 16 cuts a groove and vice versa. After the board leaves the central table it passes onto the output carriage 19 guided by an output side fence 31 which is also aligned with the central side fence 28. In FIG. 1B the board 23 is shown on the input carriage 18 prior to side edge cutting and in its moved position on the output carriage 19 after the sides have been shaped and the top face planed on the central table.

Figure 1C:
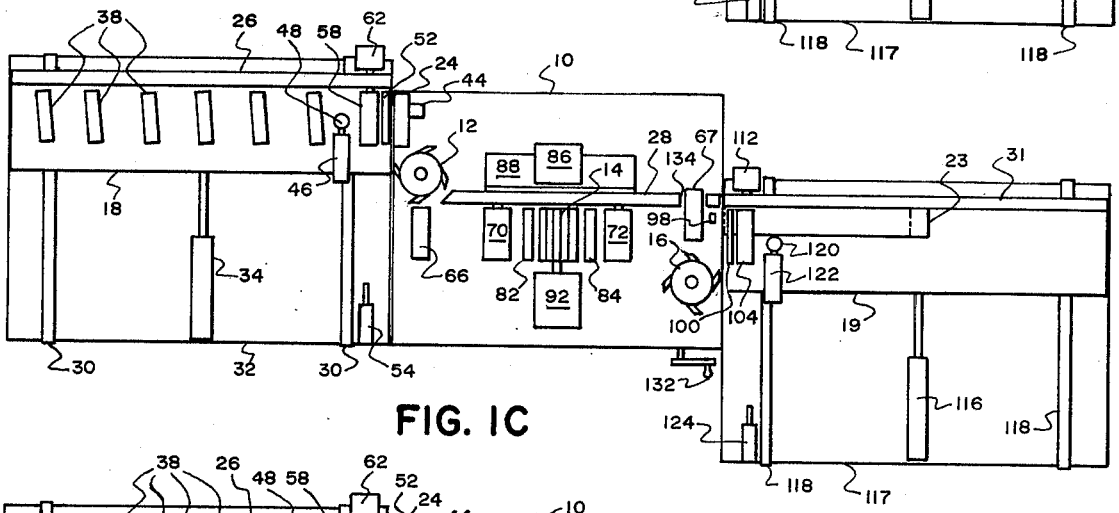
FIG. 1C is a top schematic view of the apparatus in a second intermediate configuration showing the board after it has been shaped along both side edges as well as one end edge, and has been planed on one face.

Subsequently, the board 23 is caused to move longitudinally backward on the output carriage 19 to a predetermined position, as shown in FIG. 1C, so that the remaining uncut trailing end of the board may be shaped by the second cutting head 16. At the aforementioned predetermined position the trailing end slightly overlaps the edge of the central table so that it will contact the cutting head 16 as it passes thereby.

Figure 1D:
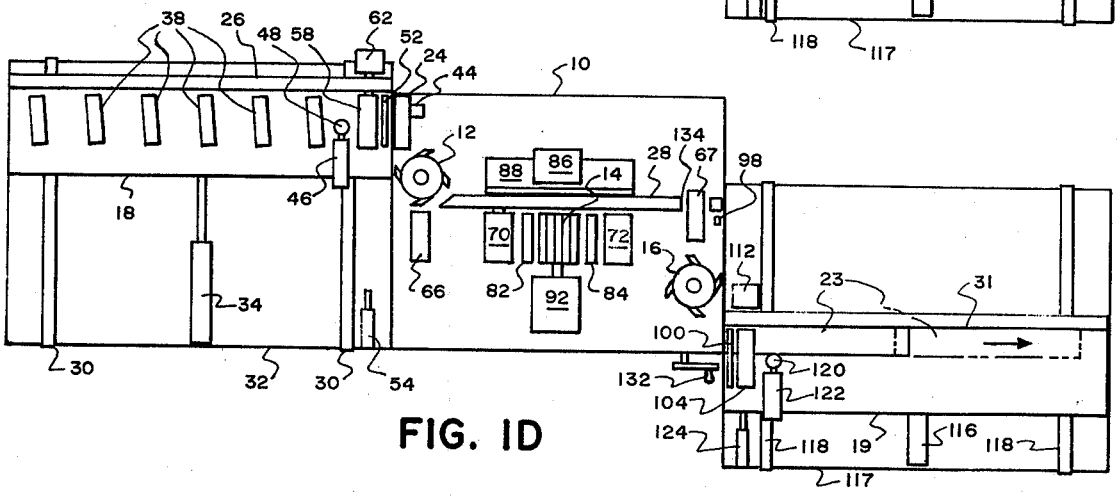
FIG. 1D is a top schematic view showing the apparatus in a final configuration showing the board after its remaining end edge has been shaped.

The output carriage 19 then moves to a translated position as shown in FIG. 1D, thereby moving the trailing end of the board 23 laterally past the cutting head 16 in contact therewith and cutting the same shape in that end as was cut in the second side of the board, leaving the board matched on both sides and ends for interlocking entirely around the periphery thereof. In the simplest form of the invention the operations on the board are completed following these steps and the finished board is then ejected.

Referring particularly to the exemplary apparatus of the invention as shown in FIGS. 1A, 1B, 2 and 3, the input carriage 18 is supported by a pair of slides 30 on an input carriage table 32 so that it may move laterally back and forth from a normal position, as shown in FIG. 1A, to a translated position as shown in FIG. 1B. Movement of the input carriage from one position to another is preferably accomplished by a hydraulic cylinder 34 actuated by the control logic 22 shown in FIG. 3. The carriage is equipped with a plurality of powered positioning rollers 38, driven by any convenient means such as a hydraulic motor 40, see FIG. 3, for positioning a raw paneling board 23 on the carriage in preparation for edge shaping and face surfacing. These positioning rollers are mounted at an acute angle to the side fence 26 toward the front fence 24, slightly less than perpendicular to the side fence, and they rotate in a clockwise direction, with reference to FIG. 2, so that when a board 23 is placed thereon it will be moved laterally against the fence 26 and forwardly against the fence 24. Preferably the input carriage is also provided with an idler roller 42, spring loaded downwardly to rest on top of the board 23 to provide pressure against the rollers 38, thereby preventing the board from bouncing backward from the front fence 24.

Proper positioning of a board on the input carriage is detected by a first pneumatic control valve 44 attached to the end fence 24 such that it is actuated when the leading end of a board strikes the fence. Actuation of the valve causes the control logic 22 to operate a pneumatic cylinder 46 which presses an input side roller 48 against the board thereby holding it against the side fence 26, and to operate a pneumatic cylinder 50 which operates a downwardly actuated clamp 52 which holds the front end of the board in position. Actuation of the first valve 44 also causes the hydraulic cylinder 34 to be operated thereby moving the input carriage 18 from its normal position to its translated position, which causes the leading end of the board 23 to be drawn past the first edge cutting head 12 thereby shaping the leading edge of the board. Since the end fence 24 is fixedly mounted on the central table 10, it does not move with the carriage, but such movement is not necessary since the board is clamped down.

A second pneumatic valve 54, disposed upon the support table 32, detects the positioning of the input carriage in its translated position and, through the control logic 22, causes the pneumatic cylinder 50 to release the input clamp 52 and another pneumatic cylinder 56 to press a top input carriage feed roller 58 downwardly against the top of the board 23. Since air is a compressible fluid the pneumatic cylinders also tend to act like springs to adjust the presence or absence of a board and to variations in board thickness. The feed roller 58 is driven by some appropriate means such as a hydraulic motor 62 in a counter-clockwise direction, with reference to FIG. 2, and a second feed roller 60, driven in a clockwise direction, is placed beneath the feed roller so that when the top roller is pressed downwardly the rollers 58 and 60 feed the board forwardly onto the central table 10. The top roller 58 and subsequent top feed rollers of the apparatus include a rubberized surface 64 for ensuring a good grip of the board by the roller while minimizing the possibility of damage to the surface of the board.

Figure 2:
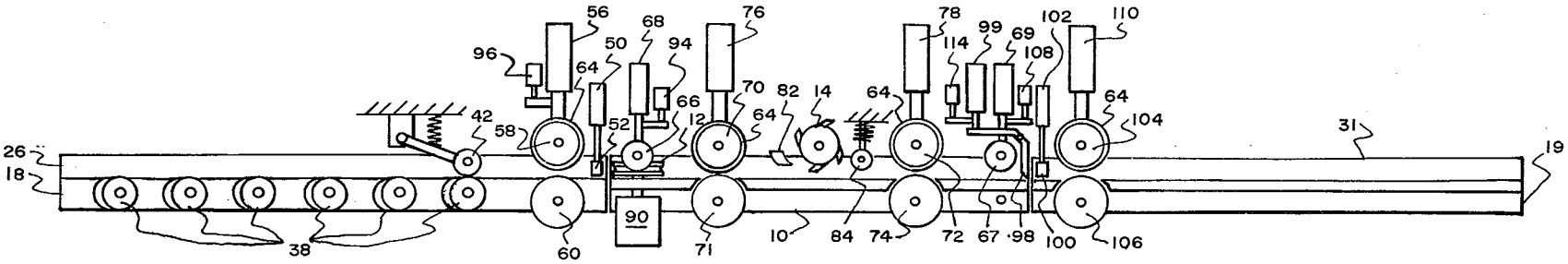
FIG. 2 is a side schematic view of the aforementioned exemplary apparatus.

Turning now primarily to FIGS. 1B, 2 and 3, the central table 10 is provided with a pair of idler rollers 66 and 67 placed respectively beside the first and second edge cutting heads and a pair of corresponding pneumatic cylinders 68 and 69 which force the rollers 66 and 67 downwardly on top of the board as it passes over the table. The central table is also provided with a first set of feed rollers 70 and 71 similar to the input feed rollers 58 and 60 respectively and a second identical set of feed rollers 72 and 74. The top central feed rollers 70 and 72 are forced downwardly against the top of the board moving over the table by a respective set of pneumatic cylinders 76 and 78. The face cutting head 14 for surfacing the top face of the board moving over the central table is located between the two feed rollers 70 and 72, so that the boards planed by the head are fed thereunder and pulled outwardly from under the head independently of the following board, thereby permitting individual boards to be operated upon separately. Also, the central table is provided with a conventional chip breaker 82 placed at the input side of the cutting head 14 and a spring-loaded hold-down roller 84 placed adjacent the output side of the head.

Figure 4:
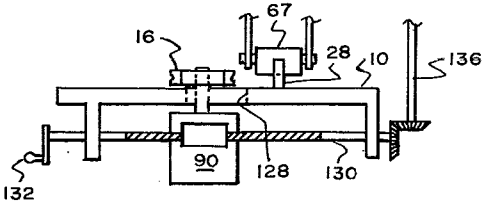
FIG. 4 is an end schematic view of a central table of the exemplary apparatus showing a mechanism for adjusting the width of boards which the apparatus will accept.

The feed rollers 70 and 72 are driven in a counter-clockwise direction and the corresponding feed rollers 71 and 74 are driven in a clockwise direction, with reference to FIG. 2, in any conventional manner, for example by a hydraulic motor 86 connected to each of the rollers by an appropriate linkage 88. Likewise, the first cutting head 12, second cutting head 16 and face cutting head 14, each of which preferably comprises a single rotating member with a plurality of cutting blades attached thereto such that the blades follow a circular cutting path as is commonly known in the art, may be driven by any appropriate means such as, for example, an electric motor 90 connected to cutting head 12 and an electric motor 92 connected to the face cutting head 14 (cutting head 16 may be driven by a motor 90 identical to cutting head 12 as shown in FIG. 4).

As a board 23 is fed off of the input carriage 18 onto the central table 10 by feed rollers 58 and 60, it runs under the first idler roller 66 and past the cutting head 12 in contact therewith such that the first edge of the board is shaped by the cutting head. The board then continues underneath the first feed roller 70 which participates in moving it beneath the chip breaker 82, the face cutting head 14 and the hold-down roller 84. Thereafter, the feed roller 72 participates in moving the board from beneath the face head 14, underneath the second idler roller 67 and past the second edge cutting head 16 which shapes the second side of the board. The side fences 26, 28 and 31 guide the board along a straight path as it moves off of the imput carriage, over the central table and onto the output carriage.

When the trailing edge of the board 23 has passed from beneath both the input feed roller 58 and the idler roller 66 on the central table the control logic 22 operates the air cylinder 56 to retract the input feed roller 58 and the hydraulic cylinder 34 to return the input carriage to its normal position. This is achieved by the use of a third pneumatic valve 94 connected to the idler roller 66 which detects the absence of a board underneath the idler 66 and a fourth pneumatic valve 96 connected to the input feed roller 58 which ensures that a signal will be transmitted to the control logic by the valve 94 only when no board is beneath roller 58. Exemplary valves and interconnections for accomplishing this result are shown in FIG. 3 where the input of valve 94, which is depressed except when a board is beneath idler 66, is connected to an output of valve 96, which is depressed only when roller 58 is moved downward by cylinder 56 and there is no board beneath the roller, and the input of valve 96 is connected to the output of valve 54, which is depressed only when the input carriage is in its translated position; however, it is recognized that other valve and logic connections could be utilized.

Turning now primarily to FIGS. 1C, 1D, 2 and 3, the central table is provided with a backstop 98 which permits a board 23 to pass forwardly thereunder but drops behind the trailing edge of the board to prevent the board from moving backward. Ordinarily the backstop is held in an up position by a pneumatic cylinder 99 so that as a board passes from the central table onto the output carriage 20 it moves beneath the backstop then beneath a retractable clamp 100 actuated by a pneumatic cylinder 102, similar to the input clamp 52, and thereafter through a set of output feed rollers 104 and 106, which are similar to those on the input carriage and are caused to rotate counterclockwise and clockwise respectively, with reference to FIG. 2, by a motor such as hydraulic motor 112. After a portion of the board passes through the output feed rollers, it is pressed against the output fence 31 by a side roller 120 and associated pneumatic cylinder 122, for guidance and positioning.

When the trailing edge of a board passes from beneath the second central idler roller 67 a fifth pneumatic valve 108 is actuated, which signals the control logic 22 and, after a predetermined time delay calculated to enable the trailing edge of the board to pass fully onto the output carriage, the control logic causes the hydraulic motor 112 to reverse, by reversing a hydraulic control valve 126, thereby reversing the direction of rotation of feed rollers 104 and 106, which moves the board rearwardly against the backstop 98 on the central table. The force against the backstop actuates a sixth pneumatic valve 114 which signals the control logic to actuate the clamp 100 by operating cylinder 102 and to remove the feed roller 104 from the top of the board. In addition, the sixth valve 114 causes the control logic to operate an output hydraulic cylinder 116 which moves the output carriage from its normal position to its translated position, thereby moving the trailing end of the board past the second cutting head 16 in contact therewith which shapes the trailing end of the board. Like the input carriage, the output carriage is supported on an output carriage table 117 by a set of slides 118 which permit the carriage to move back and forth laterally.

A seventh pneumatic valve 124 detects the positioning of the output carriage in its translated position, the trailing edge of the board having been cut. The seventh valve signals the control logic again to reverse the direction of rotation of the output feed rollers 104 and 106, causes the roller 104 to be forced against the top of the board by operating cylinder 110 and releases the clamp 100 so that the finished board 23 is ejected from the output carriage. After a predetermined delay the hydraulic cylinder 116 is then operated to return the output carriage to its normal position in preparation for another board.

It is to be emphasized that other valves and logic connections might be provided in the control system 22 to vary the sequence and timing of events and add additional operational features. For example, the system could include a manual valve 127 for operating cylinders 68, 69, 76 and 78 to retract the central table idler and feed rollers in emergency situations, and a manual valve 128 to place the input carriage in its translated position and lock the output carriage in its normal position for running boards straight through the apparatus and shaping their sides only. Also, additional pneumatic and hydraulic cylinders and motors might be added and connected with the valves through additional control logic to manipulate the boards without departing from the principles of this invention. While the hybrid pneumatic, hydraulic and electric power and control system utilized in the aforedescribed apparatus is particularly advantageous in performing the inventive method with the exemplary apparatus, other power and control systems such as purely electrical or mechanical systems could be utilized to perform the same functions without departing from the general principles of the invention.

To enable the shaping apparatus to accommodate paneling boards of various widths, it may be equipped with means for adjustng the distance between cutting heads 12 and 16, in the lateral dimension of the board, that is, a dimension perpendicular to the central side fence 28. For example, as shown in FIGS. 1A–1D and 4, the second cutting head 16 could be connected to its motor 90 by an arbor which is placed through a slot 128 in the central table 10, and the motor could be movably attached to a rotatable threaded rod 130 connected to a handle 132 so that the distance between the fence 28 and cutting head 16 can be varied by turning the handle. The idler roller 67 would in turn protrude through a slot 134 in the fence 28 and likewise be laterally adjustable by a linkage 136 which would move the idler 167 back and forth in coordination with the cutting head 16. Other means for adjusting the width of board which the apparatus would accept might also be utilized without departing from the principles of this invention.

Figure 5A:
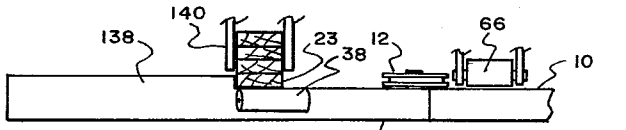
FIG. 5A is an end schematic view of an input end of the aforementioned exemplary apparatus in the initial configuration of FIG. 1A, showing an additional board-loading feature.
Figure 5B:
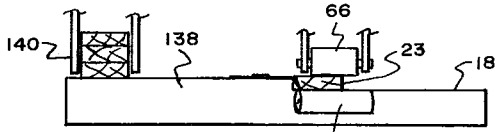
FIG. 5B is an input end schematic view of the aforementioned board-loading feature with the apparatus in an intermediate configuration corresponding to FIG. 1B.

Another feature which could be provided as part of the aforedescribed apparatus is an automatic board feeding mechanism, such as that shown in FIGS. 5A and 5B. The exemplary feed mechanism would utilize a deep side fence 138 on the input carriage and a feed trough 140 placed above and beside the side fence when the carriage is in its normal position for supplying a stack of boards 23 to the input carriage. When the input carriage moves to its translated position, as shown in FIG. 5B, it would pick off one board from the bottom of the stack for shaping, and upon return of the carriage to its normal position another board would fall down in place on top of the positioning rollers 38.

Figure 6A:
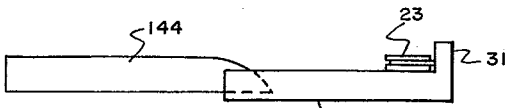
FIG. 6A is an end schematic view of the output end of the aforementioned exemplary apparatus in an intermediate configuration corresponding to FIG. 1C, showing an unloading feature of the invention.
Figure 6B:
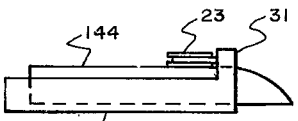
FIG. 6B is an output end schematic view of the apparatus in the final configuration corresponding to FIG. 1D, showing the aforementioned unloading feature.
Figure 6C:
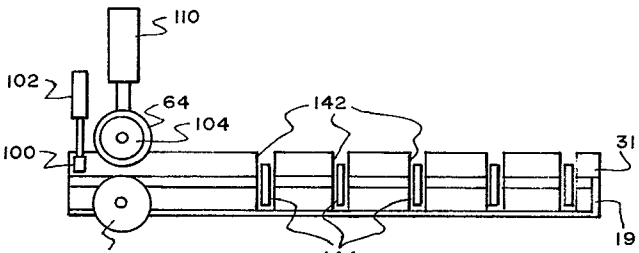
FIG. 6C is a front schematic view of the apparatus in an initial configuration corresponding to FIG. 1A, showing the unloading feature.

A further feature which may be provided in the apparatus is an unloading mechanism, such as that illustrated by FIGS. 6A–C. In the exemplary unloading feature the output carriage 20 is provided with a series of parallel slots 142 for receiving a corresponding plurality of fingers 144 of a holding table. When the output carriage is moved from its normal position to its translated position the fingers 144 slip into the slots 142 so that after the trailing edge of the board 23 is cut the board is forced up a ramp formed by the ends of the fingers. Thus, when the carriage is withdrawn to its normal position the board remains upon the fingers and the empty carriage is prepared for receiving another board. Similarly, the next board is placed upon the fingers, pushing its predecessor aside, and when the table is fully loaded the fingers may be removed and the loaded table replaced by an empty one.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for shaping the edges of a wood paneling board having a pair of opposing end edges and a pair of opposing side edges, comprising:

(a) first shaping means for cutting a first shape in a first end edge and a first side edge of said board, sequentially, as said board is moved past said first shaping means in contact therewith;

(b) input carriage means for supporting said board and moving said first end edge thereof past said first shaping means in contact therewith, thereby shaping said first end edge;

(c) second shaping means for cutting a second shape in a second side edge and a second end edge of said board, sequentially, at it moves past said second shaping means in contact therewith;

(d) feed means for moving said first side edge of said board past said first shaping means in contact therewith, thereby shaping said first side edge, and for moving said second side edge of said board past said second shaping means in contact therewith, thereby shaping said second side edge; and (e) output carriage means for supporting said board and moving said second end edge of said board past said second shaping means in contact therewith, thereby shaping said second end edge.

2. The apparatus of claim 1 wherein said second shape is complementary to said first shape so that said two shapes interlockingly match one another.

3. The apparatus of claim 2 wherein one of said two shapes is a tongue shape and the other is a groove shape.

4. The apparatus of claim 1 further comprising fence means disposed in predetermined relationship to said input carriage means, said first and second shaping means, and said output carriage means for positioning said board and guiding it past said two shaping means.

5. The apparatus of claim 4 wherein said fence means include an input side fence attached to said input carriage means for guiding and positioning said first side edge of said board and an end fence disposed adjacent said first shaping means perpendicular to said input side fence for guiding and positioning said first end edge of said board.

6. The apparatus of claim 5 further comprising means attached to said input carriage means for holding said board in a fixed position thereon.

7. The apparatus of claim 1 wherein said first shaping means and said second shaping means are mounted on a central table located between said input carriage means and said output carriage means, said two shaping means being separated from one another in the direction of movement of said board, further comprising surface cutting means disposed between said first shaping means and said second shaping means for planing a face of said board as it passes thereby.

8. The apparatus of claim 1 wherein said first shaping means and said second shaping means are separated from one another in a direction perpendicular to the direction of movement of said board, further comprising means for adjusting the perpendicular separation of said first shaping means and said second shaping means to accept various widths of boards.

9. The apparatus of claim 1 further including means associated with said input carriage for automatically loading wood paneling boards thereon.

10. The apparatus of claim 9 wherein said input carriage means moves back and forth from a normal position to a translated position, said first end edge of said board being cut during movement from said normal position to said translated position, wherein said loading means includes means for placing a new board on said input carriage means when said input carriage means returns to said normal position.

11. The apparatus of claim 1 further comprising means associated with said output carriage means for removing said board therefrom.

12. The apparatus of claim 11 wherein said output carriage means moves back and forth between a normal position and a translated position, said second end edge of said board being cut during movement from said normal to said translated position, wherein said removing means includes means for lifting said board off of said output carriage means as said output carriage means moves to its translated position.

13. An apparatus for shaping two edges of a wood paneling board, comprising:

(a) a rotating shaping means for cutting a shape in said two edges of said board, sequentially as said board moves past said shaping means in contact therewith;

(b) carriage means for supporting said board and moving a first edge of said board in a first direction past said shaping means in contact therewith, thereby shaping said first edge; and (c) feed means for moving a second edge of said board in a second direction different from said first direction past said shaping means in contact therewith, thereby shaping said second edge.

14. A method for shaping the edges of wood paneling having a pair of opposing end edges and a pair of opposing side edges, comprising:

(a) moving a first end edge of said board past a first shaping means to cut a first shape in said first end edge by said first shaping means;

(b) moving a first side edge of said board past said first shaping means to cut said first shape in said first side edge by said first shaping means;

(c) moving said second side edge of said board past a second shaping means to cut a second shape in said second side edge by said second shaping means; and (d) moving a second end edge past said second shaping means to cut said second shape in said second end edge by said second shaping means.

15. The method of claim 14 wherein steps (a)–(d) are performed in the order that they are described.

16. The method of claim 15 further comprising moving a face of said board past a surface cutting means between step (b) and step (c) for planing said face.

17. The method of claim 15 wherein step (b) and step (c) are performed simultaneously on portions of said board separated from one another in the direction of movement of the board.

18. The method of claim 14 wherein said first shape is complementary to said second shape such that the two shapes are interlockingly matched.

19. The method of claim 18 wherein one of said two shapes is a tongue shape and the other is a groove shape.

20. The method of claim 14 further comprising a step of moving a face of said board by a surface cutting means for planing said face.

21. The metod of claim 14 wherein said first and fourth directions are identical and said second and third directions are identical.

* * * * *

UNITED STATES PATENT AND TRADEMARK OFFICE

CERTIFICATE OF CORRECTION

PATENT NO. : 4,082,129

DATED : April 4, 1978

INVENTOR(S) : Donald L. Morelock

It is certified that error appears in the above-identified patent and that said Letters Patent are hereby corrected as shown below:

Col. 10, line 43 Change "at" to --as--.

Col. 11, line 47 After "sequentially" add a comma (,).

Cancel claim 21.

On the cover sheet, after the Abstract, "21 Claims" should read

-- 20 Claims --.

Signed and Sealed this

*Third* Day of *October 1978*

[SEAL]

*Attest:*

RUTH C. MASON
*Attesting Officer*

DONALD W. BANNER
*Commissioner of Patents and Trademarks*